US006539903B2

(12) United States Patent
Bonet Martinez

(10) Patent No.: US 6,539,903 B2
(45) Date of Patent: Apr. 1, 2003

(54) COMPOUND MOVEMENT ELLIPTIC VALVE ASSEMBLY

(76) Inventor: Luis Enrique Bonet Martinez, Craywinckel, 17 2°-2ª, 08034 Barcelona (ES)

( * ) Notice: Subject to any disclaimer, the term of this patent is extended or adjusted under 35 U.S.C. 154(b) by 0 days.

(21) Appl. No.: 10/096,000

(22) Filed: Mar. 12, 2002

(65) Prior Publication Data

US 2002/0096135 A1 Jul. 25, 2002

Related U.S. Application Data

(63) Continuation of application No. PCT/ES00/00181, filed on May 18, 2000.

(51) Int. Cl.[7] ..... F01L 1/32
(52) U.S. Cl. ..... 123/90.28; 123/90.3
(58) Field of Search ..... 123/90.2, 90.28, 123/90.29, 90.3, 90.65

(56) References Cited

U.S. PATENT DOCUMENTS 1,414,499 A * 5/1922 Buck ..... 123/90.28
4,309,966 A * 1/1982 Klomp ..... 123/90.28
4,424,773 A * 1/1984 Wendel et al. ..... 123/90.29
4,739,968 A * 4/1988 Schabinger ..... 251/304
5,322,039 A * 6/1994 Kinsey ..... 123/90.67

FOREIGN PATENT DOCUMENTS

JP 60-6011 * 1/1985

* cited by examiner

*Primary Examiner*—Weilun Lo
(74) *Attorney, Agent, or Firm*—Katten Muchin Zavis Rosenmam

(57) ABSTRACT

The invention aims at achieving better filling of the cylinders located in the body of the valve (1) by implanting valves (2) with an elliptical head (3) whose linear opening/closing movement is complemented by a lateral rotation with a 55° amplitude, said rotational movement being accomplished by using a guide (8) having two symmetrical and helicoidal tracks (9) on which two pivots (10) that are provided for said purpose can slide on points diagonally opposite to the stem pertaining to the corresponding valve (2). The overhead with the composite movement elliptical valves can be used in all internal combustion engines such as spark ignition or compression ignition internal combustion engines regardless of the number of cylinders and their utilization.

5 Claims, 2 Drawing Sheets

COMPOUND MOVEMENT ELLIPTIC VALVE ASSEMBLY

This application is a continuation of PCT/ES00/00181 filed May 18, 2000.

DESCRIPTION

Object of the Invention

The invention relates to an elliptic valve assembly with compound movement, the novel characteristics of which are that the valve have elliptic heads and in that the motion they describe in the opening and closing process is a combined motion, with a lateral rotation movement in addition to the linear displacement.

The object of the invention is to provide automobile engine manufacturers with a cylinder head with novel valves, in both their configuration and their movement, by which an improved filling of the engine cylinders is obtained as a result of a greater passage section towards the cylinder as compared to conventional valves with a circular head.

BACKGROUND OF THE INVENTION

In cylinder heads with circular section valves and an opening and closing mechanism implying a linear displacement, it is common that the passage section between the valve and the chamber is limited by the characteristics of the head itself, whether hemispherical, flat or Heron type.

As is known, valves are the closing elements placed between the interior of the cylinders and the inlet and exhaust ducts of the head of an internal combustion engine, so that as any other closing element at the moment when it allows passage it is obstructing the inlet or outlet of the passing fluid, but are necessary to block the connection between the various parts during the remaining cycles.

Conventional valves with a circular head, whether they are driven directly by the cams or by rockers, are mechanical elements with a to-and-fro rocking motion, for which they require two forces to perform their function: one to open, and another to close them returning them to their original closed position.

Once the valve is open it must be closed once again, following the camshaft arrangement, for which a spring is required to exert a force allowing an acceleration identical to that of the lift or displacement to carry out the aforementioned function. In practice the situation is otherwise, as when the valve is lifted the force required must provide the required acceleration to the mass while opposing the action of the spring which will return the valve to its original position.

A number of embodiments exist which are based on different valve systems with alternating motion, among which the following may be cited:

- MIESSE engine, with a single pipe for inlet and exhaust which may be used for both by the displacement of a partition in the form of a piston.
- SPHINX engine with ring valves, which is actually an improvement on the KNICHT runner, port type.
- HEWITT engine, in which the conventional valves are replaced by synchronized pistons.
- FISHER engine, which lacks valves but includes ports which in turn are controlled by an ingenious pistons system, which may be seen as a combination of the aforementioned system.

Examples of devices which include valves which, in addition to a linear displacement, also move their head laterally are among others U.S. Pat. No. 4,309,966 and Japanese Patent JP 60006011, although in the first case the valve is circular and in the second it is a perfect ellipse with its head coupled to the shaft in a non-eccentric manner, which prevents the devices disclosed in these documents from providing an ideal passage section and thereby an optimum inlet and exhaust flow to the cylinders.

DESCRIPTION OF THE INVENTION

The valve cylinder head object of the invention provides a solution to the problems presented by conventional valve heads, as in addition to providing new characteristics which result in an improved performance of the engine in which the valve head is installed.

More specifically, the novelty of the cylinder head of the invention is an improved filling of the cylinders, increasing the passage section of conventional valves. That is, using the same mechanical base the innovation of the valve head of the invention lies in an operation similar to that of a runner, with the resulting increased filling of this solution as well as a structural simplicity which can be assimilated in current manufacturing processes without requiring great changes.

This increased passage section by which an improved cylinder fill is attained is achieved by the use of valves with an elliptic head, whose opening and closing motion is complemented by a lateral rotation motion. This latter motion requires the valves to be internally guided by a pair of lugs placed diametrically opposite each other on the corresponding shaft. These lugs move along symmetrical helical tracks made for such purpose in the valve shaft housing, thereby enabling the rotation which is determined to be between 50° and 65°.

To allow the insertion of the valves, the machining of these symmetrical helical tracks which make up the guide will be as far as the bottom end of said valves, and complemented by a metal retainer threaded in the position corresponding to said bottom end in order to prevent leaks through said tracks.

In addition, it should be remarked that the valves are complemented by springs similar to those used in circular valve heads with alternate motion, which springs allow to control the usual opening/closing movement and that of the lateral rotation.

The use of the cylinder head with elliptic valves with compound motion, in accordance with the above, will provide a higher efficiency than any other multi-valve system currently employed, as the application of the system will imply an improved filling of the cylinders; in addition by giving the valves a rotation movement a runner-like passage section is achieved, free of obstacles, allowing the mixture to enter more quickly into the cylinders in the inlet process, thereby allowing a greater sweep of the gases in the exhaust process, thereby achieving their exhaust as well as a greater thermodynamic efficiency.

That is, by achieving an improved filling the volumetric coefficient of the inlet is increased, providing a higher specific power and an improved combustion of the fuel, with the ensuing reduced emission of CO and NO type gases.

Obtaining a higher engine torque at lower revolutions allows manufacturing engines with improved usage capacity at all revolutions.

Considering that the industrialization of the elliptic valve head object of the invention does not require significant changes with respect to current heads, as relates to the size and use of the same movement distribution systems (camshaft), and inlet and exhaust ducts, this will allow a great improvement with a simple application as all other elements are readily applicable as there are no costly innovation processes required in the manufacture production lines.

DESCRIPTION OF THE DRAWINGS

These and further characteristics of the present invention will become clearer in view of an accompanying set of drawings of a preferred embodiment of the invention, where for purposes of illustration only the following is shown.

PREFERRED EMBODIMENT OF THE INVENTION

Figure 1:
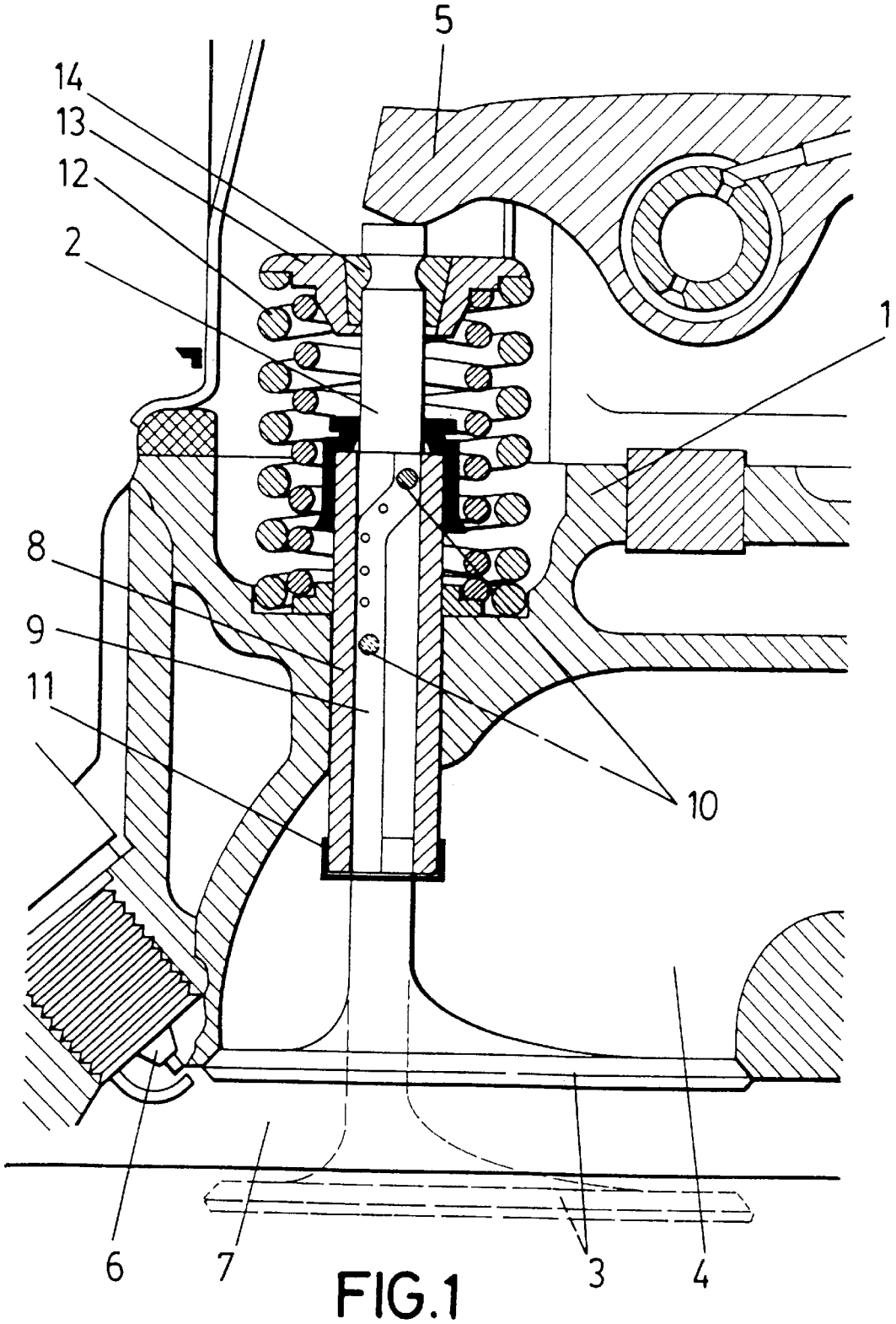
FIG. 1 shows a sectional view of part of the cylinder head with the elliptic head valve object of the invention, revealing all of the main and innovative characteristics of the invention.

In view of the above described figures one can see a part of a cylinder head (1) on which is mounted a valve (2) with a head (3) having an elliptical configuration, placed on the passage of the inlet or exhaust duct (4), with the corresponding rocker (5) acting on the top end of said valve (2).

In this part of the head (1) can also be seen an ignition plug (6) and the top part (7) of the cylinder where the combustion occurs.

Figure 2:
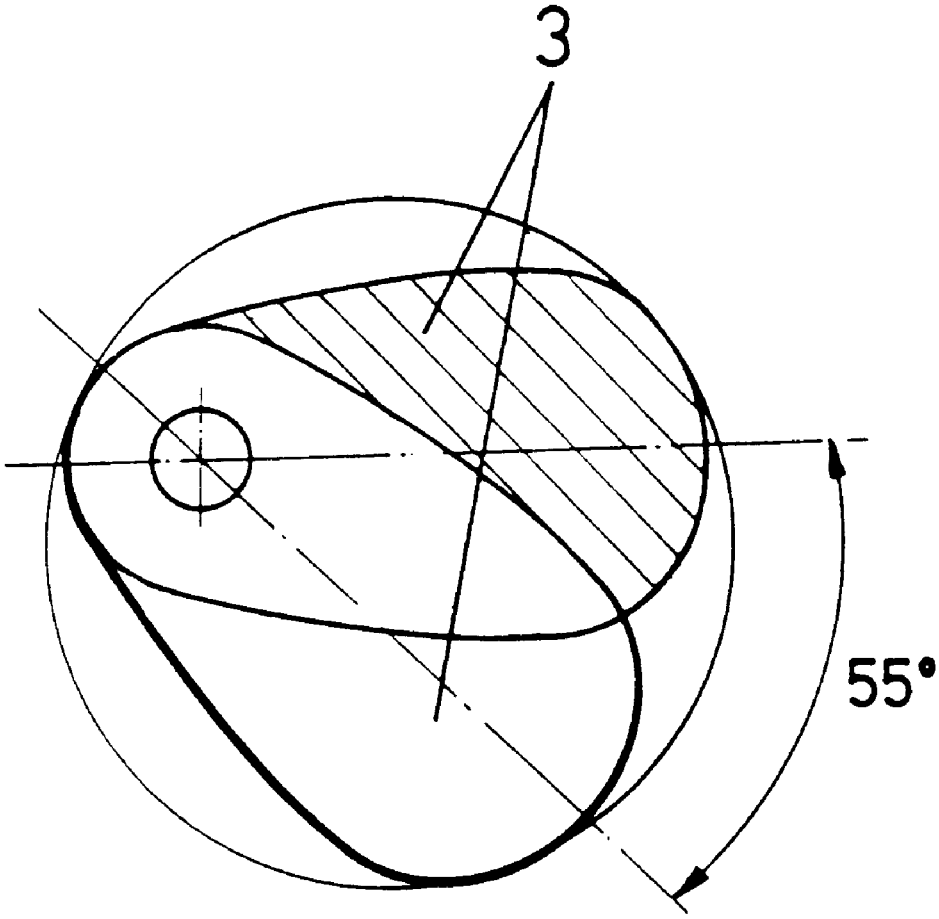
FIG. 2 shows a plan view of the elliptic outline of the valve head incorporated in the cylinder head of the invention, shown in its end rotation positions at an angle between 50° and 65°.

One of the novel characteristics of the invention is based on the elliptic configuration of the head (3) of valve (2), as well as the establishment of a special guide (8) in the housing of the shaft of the valve (2), which guide (8) is provided with two tracks (9) symmetrically arranged and having a helical configuration, in which slide and are guided corresponding lugs (10) provided for such purpose diametrically opposite each other in the shaft of valve (2). FIG. 1 shows said valve in two positions, one closed and, in a broken line, one open. In each position is shown the situation of the lug (10) in the corresponding track (9) in guide (8). FIG. 2 shows that the valve head has an elliptical configuration with opposing edge areas, one area being narrower than the other area, and that the valve shaft is eccentrically joined to the valve head at the narrower edge area.

These tracks (9) are machined as far as the bottom end, at which point is provided a metal retainer (11) which is threaded in to prevent leaks through said tracks (9) of the guide (8).

Furthermore, the valve is complemented by a pair of coil springs (12) mounted between a cavity of the cylinder head (1) and a top cap (13) which acts as a stop, aided by a set key (14).

In accordance with the above described characteristics, the valve (2) undergoes a two-fold motion, as it has a linear motion, as is conventional, and in addition a simultaneous rotation with an amplitude between 50° and 65°, as shown in FIG. 2, with the double axial and rotational motion guided by the sliding of the lugs (10) of the shaft of valve (2) on the tracks (9) of guide (8) made for such purpose in the housing of said valve shaft.

I claim:

1. Compound movement elliptic valve assembly of an internal combustion engine including at least one cylinder having an inside and a duct with an oval outline, said valve assembly comprising:

at least one valve having a valve shaft with a shaft axis and a valve head that acts as a sealing element interposed between the inside of the at least one cylinder and the duct;

the valve head having an elliptical configuration with opposing edge areas, one area being narrower than the other area;

the valve shaft being eccentrically joined to the valve head in the narrower edge area; and the valve moving along a guide that houses a portion of the shaft, the valve shaft being rotatable and slidably movable within the guide.

2. Compound movement elliptic valve assembly, as claimed in claim 1, wherein the guide by which the at least one valve rotates includes two symmetrical and helical tracks in which slide corresponding lugs provided on the valve shaft on diametrically opposite locations.

3. Compound movement elliptic valve assembly, as claimed in claim 2, wherein the guide has a bottom end and the tracks extend to the bottom end of said guide, with said bottom end closed by a metal retainer with a threaded mounting.

4. Compound movement elliptic valve assembly, as claimed in claim 1, wherein the at least one valve further comprises a top and a pair of coil springs for the restoration of said valve to its closed position, with the springs held on the top by a cup and a set key.

5. Compound movement elliptic valve assembly, as claimed in claim 1, wherein the angular amplitude of the rotation of the at least one valve is between 50° and 65°.

* * * * *